US012704290B2

(12) United States Patent
Kang

(10) Patent No.: US 12,704,290 B2
(45) Date of Patent: Aug. 11, 2026

(54) AIR CONDITIONER INDOOR UNIT

(71) Applicants: MIDEA GROUP CO., LTD., Foshan (CN); GD MIDEA AIR-CONDITIONING EQUIPMENT CO., LTD., Foshan (CN)

(72) Inventor: Tiesheng Kang, Foshan (CN)

(73) Assignees: MIDEA GROUP CO., LTD., Foshan (CN); GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 384 days.

(21) Appl. No.: 18/529,744

(22) Filed: Dec. 5, 2023

(65) Prior Publication Data

US 2024/0102692 A1 Mar. 28, 2024

Related U.S. Application Data

(63) Continuation of application No. PCT/CN2021/122411, filed on Sep. 30, 2021.

(30) Foreign Application Priority Data

Jun. 7, 2021 (CN) ..... 202110633832.7
Jun. 7, 2021 (CN) ..... 202121269822.1

(51) Int. Cl.
*F24F 13/20* (2006.01)
*F24F 1/0071* (2019.01)

(52) U.S. Cl.
CPC ..... *F24F 13/20* (2013.01); *F24F 1/0071* (2019.02)

(58) Field of Classification Search
CPC ..... F24F 13/20; F24F 1/0071
(Continued)

(56) References Cited

U.S. PATENT DOCUMENTS

2017/0138613 A1 5/2017 Bai et al.
2019/0390860 A1* 12/2019 Han ..... F24F 1/0007
(Continued)

FOREIGN PATENT DOCUMENTS

AU 2018 327 937 A1 4/2020
CN 202885193 U 4/2013
(Continued)

OTHER PUBLICATIONS

International Search Report dated Feb. 28, 2022 issued in PCT/CN2021/122411.
(Continued)

*Primary Examiner* — Avinash A Savani
*Assistant Examiner* — Dana K Tighe
(74) *Attorney, Agent, or Firm* — Scully, Scott, Murphy & Presser, P.C.

(57) ABSTRACT

An air conditioner indoor unit is provided. The air conditioner indoor unit includes a housing and a door opening and closing device. The housing has a vent and a mounting boss. The mounting boss has a first shaft hole and a mounting notch that is in communication with the first shaft hole. The door opening and closing device includes a valve, a motor cover, and a motor. The valve is located at the vent. The valve includes a first pivoting portion. A motor shaft of the motor cooperates with the first pivoting portion. The first pivoting portion is mounted in the first shaft hole through the mounting notch. The motor cover is fixed at the mounting boss.

12 Claims, 12 Drawing Sheets

(58) Field of Classification Search
USPC ..... 454/254
See application file for complete search history.

(56) References Cited

U.S. PATENT DOCUMENTS

| | | | | |
|---|---|---|---|---|
| 2020/0166240 | A1 | 5/2020 | Liu et al. | |
| 2022/0268460 | A1* | 8/2022 | Ugai | F25B 13/00 |
| 2023/0003397 | A1* | 1/2023 | Liu | F24F 1/22 |

FOREIGN PATENT DOCUMENTS

| | | | |
|---|---|---|---|
| CN | 104121631 | A | 10/2014 |
| CN | 108087986 | A | 5/2018 |
| CN | 108361812 | A | 8/2018 |
| CN | 207936317 | U | 10/2018 |
| CN | 208075132 | U | 11/2018 |
| CN | 209181106 | U | 7/2019 |
| CN | 111295554 | A | 6/2020 |
| CN | 216346677 | U | 4/2022 |
| EP | 2602563 | A1 | 6/2013 |
| JP | 2016223681 | A | 12/2016 |

OTHER PUBLICATIONS

Extended European search report dated Sep. 10, 2024 received in European Patent Application No. 21944807.3.
Written Opinion dated Feb. 28, 2022 issued in PCT/CN2021/122411.
First Office Action dated Dec. 16, 2024 received in Chinese Patent Application No. 202110633832.7.
Decision of Grant dated Apr. 11, 2025 received in Chinese Patent Application No. 202110633832.7.

* cited by examiner

AIR CONDITIONER INDOOR UNIT

CROSS-REFERENCE TO RELATED APPLICATIONS

The present application is a continuation application of International Application No. PCT/CN2021/122411, filed on Sep. 30, 2021, which claims priorities to Chinese Patent Application Nos. 202110633832.7 and 202121269822.1, titled "AIR CONDITIONER INDOOR UNIT," and filed with China National Intellectual Property Administration on Jun. 7, 2021, the entire contents of each of which are incorporated herein by reference for all purposes. No new matter has been introduced.

FIELD

The present disclosure relates to the field of air conditioners, and more particularly, to an air conditioner indoor unit.

BACKGROUND

At present, with continuous development of science and technology, more household electrical appliances have been applied in people's daily life and work. Taking an air conditioner indoor unit as an example for household electrical appliances, most of existing air conditioner indoor units are provided with a mounting plate. A door opening and closing device of the air conditioner indoor unit is required to be mounted on the mounting plate and is subsequently mounted on a housing. Therefore, this structure needs to be fixed twice. This mounting method may lead to a complex assembly process of the air conditioner indoor unit, which is time-consuming and incurs high cost. The structure is prone to loosening due to the vibration during the operation of the air conditioner indoor unit, which reduces reliability of products.

SUMMARY

The present disclosure aims to solve at least one of the technical problems in the related art. To this end, the present disclosure provides an air conditioner indoor unit. A door opening and closing device of the air conditioner indoor unit that has been assembled into one piece can be directly assembled to a housing. The air conditioner indoor unit has a simple structure and is convenient to assemble, thereby reducing costs of the product and improving reliability of the product.

The air conditioner indoor unit according to an embodiment of the present disclosure includes a housing and a door opening and closing device. The housing has a vent and includes an inner wall provided with a mounting boss. The mounting boss has a first shaft hole and a mounting notch formed at a side wall of the mounting boss facing away from the housing, the mounting notch is in communication with the first shaft hole, and the mounting boss is located at a side of the vent. The door opening and closing device includes a valve, a motor cover, and a motor. The valve is rotatably located at the vent to open or close the vent, and is provided with a first pivoting portion rotatably engaged to the first axial hole. The motor has a motor shaft cooperating with the first pivoting portion to drive the valve to rotate. The motor cover internally has a mounting space for the motor, the first pivoting portion assembled with the motor is mounted in the first shaft hole through the mounting notch, and the motor cover is fixed at the mounting boss.

In the air conditioner indoor unit according to the embodiment of the present disclosure, the housing cooperates with the door opening and closing device, and the door opening and closing device that has been assembled into one piece can be directly assembled to the housing. Accordingly, the air conditioner indoor unit has a simplified structure and is convenient to assemble, thereby reducing costs of the product and improving reliability of the product.

In some embodiments of the present disclosure, the motor cover is provided with a first snap portion and a first fixing portion. The mounting boss is provided with a second snap portion and a second fixing portion. The first snap portion is snapped with the second snap portion. Each of the first fixing portion and the second fixing portion cooperates with a fixing connector to fixedly connect the motor cover and the mounting boss.

In some embodiments of the present disclosure, the first snap portion is a resilient snap. The second snap portion is a limit protrusion disposed at the mounting boss. A snap space is formed between the limit protrusion and the inner wall of the housing. The resilient snap partially extends into the snap space and abuts against the limit protrusion.

In some embodiments of the present disclosure, the limit protrusion has a snap-guiding surface obliquely extending towards the inner wall of the housing. The snap-guiding surface is engaged with the first snap portion to guide the first snap portion partially into the snap space.

In some embodiments of the present disclosure, the first fixing portion is a through hole formed at the motor cover. The second fixing portion is a fixing post. The motor cover is provided with a limit rib engaged with an outer peripheral wall of the fixing post to limit the fixing post.

In some embodiments of the present disclosure, the mounting boss is provided with a first guide member. The motor cover is provided with a second guide member. The first guide member and the second guide member are engaged with each other to guide the motor cover to a fixing position when mounting the opening and closing door device.

In some embodiments of the present disclosure, the first guide member is an arc-shaped guide plate disposed outside of the first shaft hole. The second guide member is a guiding post disposed at the motor cover.

In some embodiments of the present disclosure, the air conditioner indoor unit further includes a positioning boss disposed at the inner wall of the housing. The motor cover is partially located between the positioning boss and the mounting boss to restrict a freedom of movement of the motor cover.

In some embodiments of the present disclosure, a spacing between opposing sidewalls of the mounting notch gradually increases away from the first shaft hole.

In some embodiments of the present disclosure, a side wall of the vent opposite to the first shaft hole is formed into a support plane, and the support plane has a second shaft hole. The valve is provided with a second pivoting portion rotatably engaged to the second shaft hole.

In some embodiments of the present disclosure, the housing has a plurality of vents, and the air conditioner indoor unit includes a plurality of door opening and closing devices. Each of the plurality of door opening and closing devices is provided for one of the plurality of vents. The motor cover is formed into a symmetrical structure that is symmetrical with respect to a rotation center axis of the motor shaft. The motor covers of the plurality of door opening and closing devices have a same shape.

In some embodiments of the present disclosure, the mounting boss and the housing are integrally formed.

In some embodiments of the present disclosure, the housing is internally provided with a purification device. The vent is an indoor air inlet. When the valve is opened, indoor air flows into the housing through the vent and is discharged after being purified by the purification device.

Additional aspects and advantages of the present disclosure will be given at least partially in the following description, become apparent at least partially from the following description, or can be learned from practicing of the present disclosure.

DETAILED DESCRIPTION OF EMBODIMENTS

Figure 1:
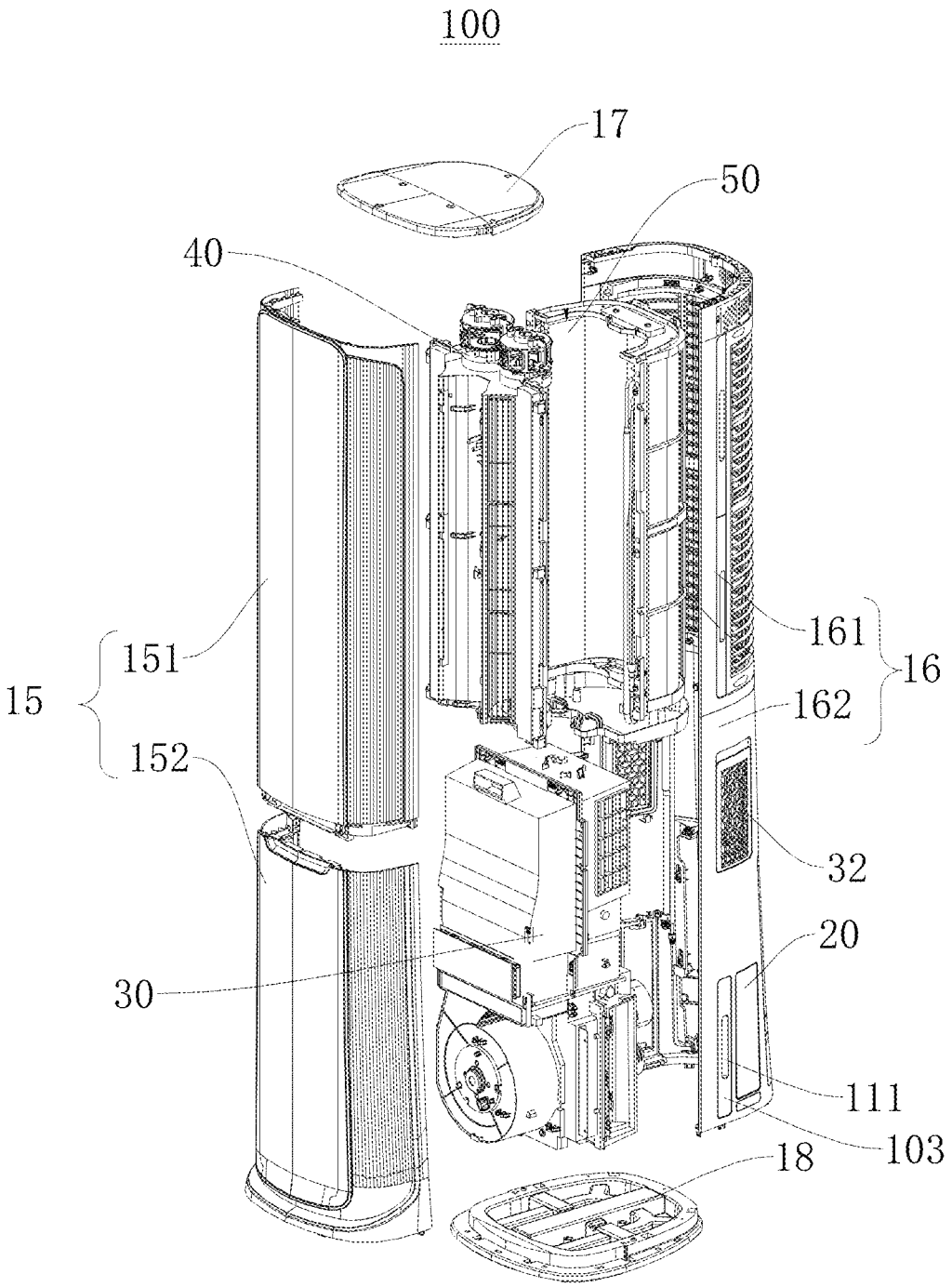
FIG. 1 is a schematic exploded view of an air conditioner indoor unit according to an embodiment of the present disclosure.

Embodiments of the present disclosure will be described in detail below with reference to examples thereof as illustrated in the accompanying drawings, throughout which same or similar elements, or elements having same or similar functions, are denoted by same or similar reference numbers. The embodiments described below with reference to the drawings are illustrative only, and are intended to explain, rather than limiting, the present disclosure. In the description of the present disclosure, it should be understood that the orientation or the position indicated by terms such as "center," "longitudinal," "lateral," "length," "width," "thickness," "over," "below," "front," "rear," "left," "right," "vertical," "horizontal," "top," "bottom," "inner," "outer," "clockwise," "anti-clockwise," "axial," "radial," and "circumferential" should be construed to refer to the orientation and the position as shown in the drawings, and is only for the convenience of describing the embodiments of the present disclosure and simplifying the description, rather than indicating or implying that the pointed device or element must have a specific orientation, or be constructed and operated in a specific orientation, and therefore cannot be understood as a limitation of the present disclosure. In addition, the features associated with "first" and "second" may explicitly or implicitly include at least one of the features. In the description of the present disclosure, "plurality" means at least two, unless otherwise specifically defined.

In the description of the present disclosure, it should be understood that, unless otherwise clearly specified and limited, terms such as "install," "connect," "connect to" and the like should be understood in a broad sense. For example, it may be a fixed connection or a detachable connection or connection as one piece; mechanical connection or electrical connection; direct connection or indirect connection through an intermediate; internal communication of two components or the interaction relationship between two components, unless otherwise clearly limited. For those skilled in the art, the specific meaning of the above-mentioned terms in the present disclosure can be understood according to specific circumstances.

An air conditioner indoor unit 100 according to certain embodiments of the present disclosure is described as follows with reference to FIG. 1 to FIG. 14.

As shown in FIG. 1 to FIG. 14, the air conditioner indoor unit 100 according to the embodiments of the present disclosure includes a housing 10 and a door opening and closing device 20. The housing 10 may have a vent 11 and an inner wall provided with a mounting boss 12. The mounting boss 12 may have a first shaft hole 121 and a mounting notch 122 formed at a sidewall of the mounting boss 12 facing away from the housing 10. The mounting notch 122 may be in communication with the first shaft hole 121. The mounting boss 12 is disposed at a side of the vent. The door opening and closing device 20 may include a valve 21, a motor 23, and a motor cover 22. The valve 21 may be disposed at the vent 11 to open or close the vent 11 in a rotatable manner, and may be provided with a first pivoting portion 211 engaged to the first shaft hole 121. The motor 23 has a motor shaft 231 cooperating with the first pivoting portion 211. The motor 23 drives the first pivoting portion 211 to rotate, thereby driving the valve 21 to rotate. The motor cover 22 may have an internal mounting space for mounting the motor 23. The first pivoting portion 211 assembled with the motor 23 may be mounted in the first shaft hole 121 through the mounting notch 122. The motor cover 22 is fixed at the mounting boss 12.

It should be noted that the air conditioner indoor unit 100 may further include an evaporator component 50 and an air channel component 40. The evaporator component 50 may perform heat exchange to air to realize cooling or heating of the air conditioner indoor unit 100. The air channel component 40 may perform air suction and air supply. The housing 10 may protect the evaporator component 50 and fix the door opening and closing device 20. The housing 10 may be directly connected to the door opening and closing device 20. The housing 10 may include a front box component 15, a rear box component 16, a top cover 17, and a chassis 18. The front box component 15 may include an upper front box member 151 and a lower front box member 152. The rear box component 16 may include an upper rear box member 161 and a lower rear box member 162. The upper front box member 151, the lower front box member 152, the upper rear box member 161 and the lower rear box member 162 may be connected together by snapping. It can be understood that the connection manner of the upper front box member 151, the lower front box member 152, the upper rear box member 161 and the lower rear box member 162 is not limited thereto. For example, the upper front box member 151, the lower front box member 152, the upper rear box member 161 and the lower rear box member 162 may be connected by screws or the like.

The valve 21 may be mounted at the vent 11 of the housing 10. The motor 23 may be mounted in the mounting space of the motor cover 22. The mounting boss 12 and the motor cover 22 are fixed with respect to each other. Therefore, the door opening and closing device 20 can be directly assembled on the housing 10. In an embodiment, the housing 10 may have two vents 11 and two mounting bosses 12. The two vents 11 and the two mounting bosses 12 may be disposed on left and right sides of the lower rear box member 162, respectively. The mounting bosses 12 may be disposed on an upper side of the vents 11, and the upper side of each of the vents 11 corresponds to one of the mounting bosses 12. It should be described that the upper and lower orientations are described only with reference to the drawings. The number of the valves 21 and the number of the motors 23 both correspond to the number of the mounting bosses 12. The door opening and closing device 20 may include two valves 21 and two motors 23. It should be understood that the number of the vents 11 and the number of the mounting bosses 12 are not limited thereto, and may be provided based on actual requirements. For example, in order to produce a better air outflowing effect, the number of the vents 11 and the number of the mounting bosses 12 are provided to three, four, etc.

In an embodiment, when the door opening and closing device 20 needs to be assembled, the motor 23 is connected to the valve 21, and subsequently the motor 23 is mounted in the motor cover 22. After the door opening and closing device 20 is assembled into one piece, the mounting notch 122 mounts the first pivoting portion 211 into the first shaft hole 121, and subsequently the motor cover 22 is fixed on the mounting boss 13. In an embodiment, the motor 23 is fixed in the motor cover 22 by screws.

Therefore, the mounting boss 12 is disposed at the housing 10, enabling the housing 10 and the door opening and closing device 20 to cooperate with each other. The door opening and closing device 20 assembled into one piece can be directly assembled on the housing 10, which enables the air conditioner indoor unit to have a simple structure and be convenient to assemble, thereby reducing costs of the product and improving reliability of the product. In some embodiments of the present disclosure, as shown in FIG. 6 to FIG. 14, the motor cover 22 is provided with a first fixing portion 222 and a first snap portion 221. The mounting boss 12 is provided with a second fixing portion 124 and a second snap portion 123. The second snap portion 123 is engaged with the first snap portion 221. Each of the second fixing portion 124 and the first fixing portion 222 may cooperate with a fixing connector 24 to fixedly connect the mounting boss 12 and the motor cover 22. The fixing connector 24 is provided in a form of a screw, and the second fixing portion 124 is screwed with the first fixing portion 222, which enables the mounting boss 12 and the motor cover 22 to be fixed at a position. In an assembly process, the second snap portion 123 and the first snap portion 221 can be snapped with each other to provide a mounting position of the motor cover 22. The second fixing portion 124 is aligned with the second snap portion 123. Thereafter, the second fixing portion 124 and the first fixing portion 222 are engaged with each other through screws. In this way, the motor cover 22 can be fixedly connected to the mounting boss 12, and the assembly process is simple, facilitating assembly of the fixing connector 24.

In some embodiments of the present disclosure, the second snap portion 123 may be provided in a form of a limit protrusion at the mounting boss 12, and the first snap portion 221 may be provided in a form of a resilient snap. A snap space 101 is formed between the inner wall of the housing 10 and the limit protrusion. The resilient snap may partially extend into the snap space 101 and abut against the limit protrusion. A shape of the first snap portion 221 may be a cuboid structure, and a snap hook may be provided at an end of the cuboid structure. A shape of the second snap portion 123 may be a square protrusion, and the cuboid structure may partially extend into the snap space 101 to abut against the limit protrusion through the snap hook. It should be understood that the shapes of the second snap portion 123 and the first snap portion 221 are not limited thereto. For example, the second snap portion 123 is a snap groove, and the first snap portion 221 is a snap hook. In this way, a connection strength between the mounting boss 12 and the motor cover 22 can be strengthened, and the resilient snap can improve buffering strength of the motor cover 22, thereby further improving reliability of the entire air conditioner indoor unit 100.

In some embodiments of the present disclosure, the limit protrusion may have a snap-guiding surface 125. The snap-guiding surface 125 may obliquely extend towards the inner wall of the housing 10. The snap-guiding surface 125 is engaged with the first snap portion 221 to guide the first snap portion 221 partially into the snap space 101.

In an exemplary embodiment of the present disclosure, the limit protrusion may have two snap-guiding surfaces 125. The two snap-guiding surfaces 125 are correspondingly disposed at two ends of the second snap portion 123. An inclination angle of the snap-guiding surfaces 125 extending obliquely may be 30°. It should be understood that the inclination angle of the snap-guiding surfaces 125 extending obliquely is not limited thereto. For example, the inclination angle at which the snap-guiding surfaces 125 obliquely extend may be 60°, 15°, or the like. In this way, when the second snap portion 123 and the first snap portion 221 are snapped with each other, the first snap portion 221 can be guided by the snap-guiding surfaces 125, improving an assembly efficiency of the second snap portion 123 and the first snap portion 221 and avoiding phenomenon that the assembly duration is too long due to inaccurate snap positions.

In some embodiments of the present disclosure, the first fixing portion 222 is provided in a form of a through hole, and the through hole is formed at the motor cover 22. The second fixing portion 124 is provided in a form of a fixing post, and the fixing post is disposed at the mounting boss 12. The motor cover 22 is provided with a limit rib 224 engaged with an outer peripheral wall of the fixing post to limit the fixing post. It should be noted that the second fixing portion 124 may have a through hole, and a size and shape of the through hole of the second fixing portion 124 correspond to those of the first fixing portion 222, i.e., the second fixing portion 124 and the first fixing portion 222 are arranged coaxially. The through hole of the second fixing portion 124 may be provided with a thread, the fixing connector 24 may penetrate through the second fixing portion 124 to be screwed with the first fixing portion 222. The limit rib 224 may be disposed at a lower surface of the motor cover 22. In addition, a plurality of the limit ribs 224 may be provided. The outer peripheral wall of the fixing post may engage with the plurality of limit ribs 224 to limit the fixing post. In this way, when the second fixing portion 124 and the first fixing portion 222 are connected and engaged with each other, the positions of the second fixing portion 124 and the first fixing portion 222 can be limited, facilitating connection and engagement between the second fixing portion 124 and the first fixing portion 222. The arrangement of the limit ribs 224 can further strengthen the connection strength between the mounting boss 12 and the motor cover 22, and improve the reliability of the entire air conditioner indoor unit 100.

Figure 10:
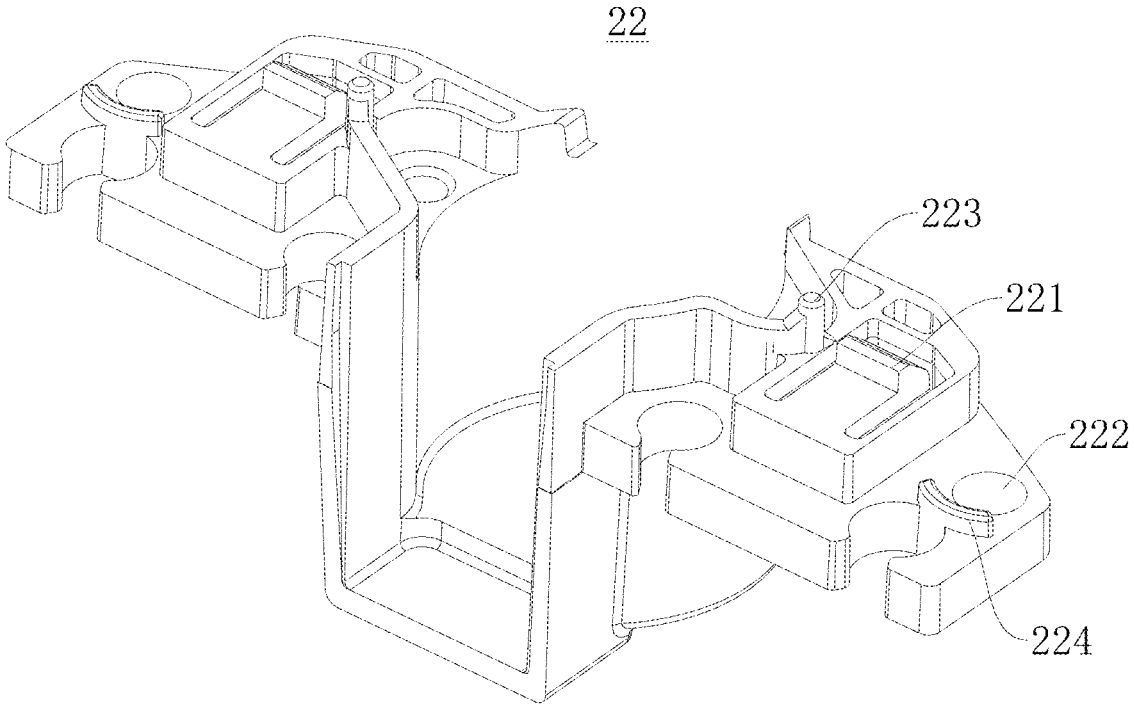
FIG. 10 is a schematic diagram of a motor cover according to an embodiment of the present disclosure.
Figure 11:
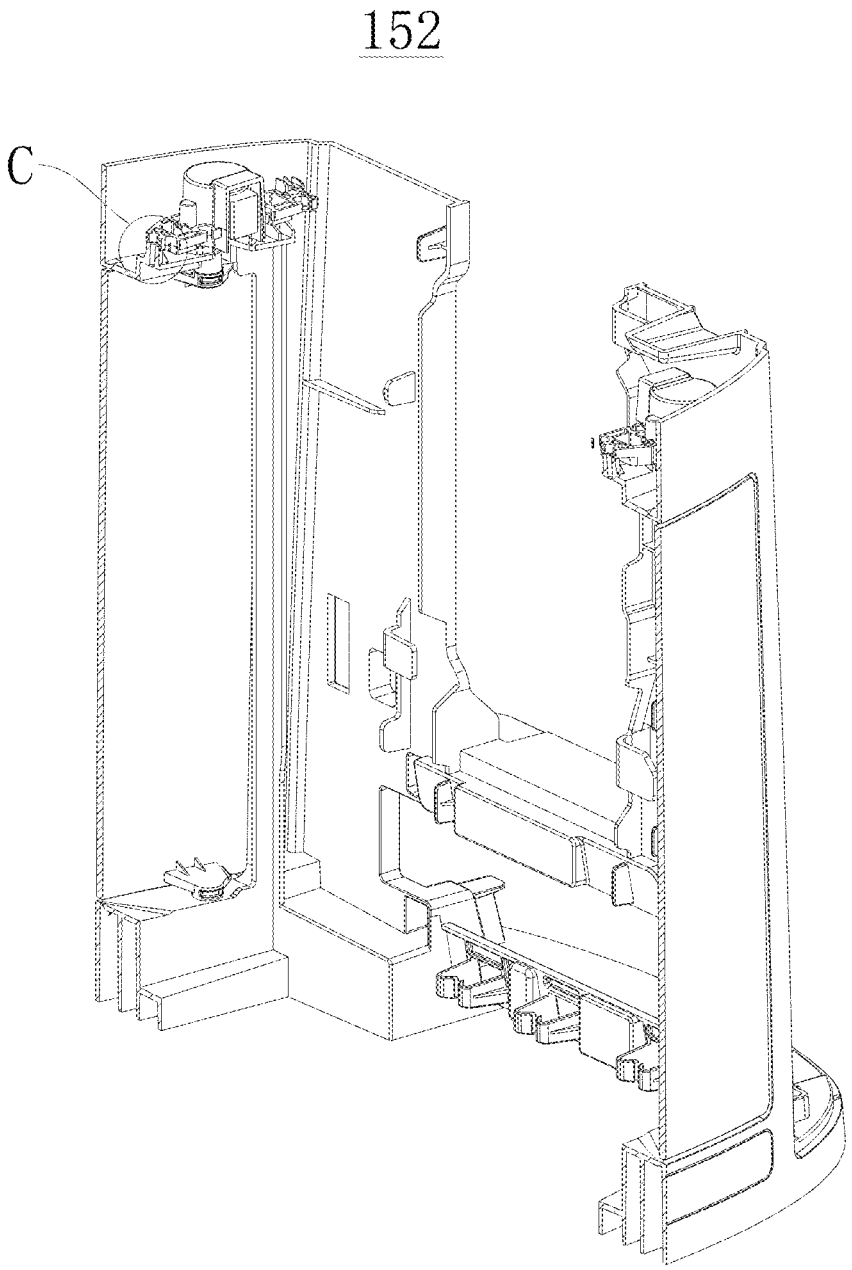
FIG. 11 is a schematic diagram of a lower front box member according to an embodiment of the present disclosure.
Figure 12:
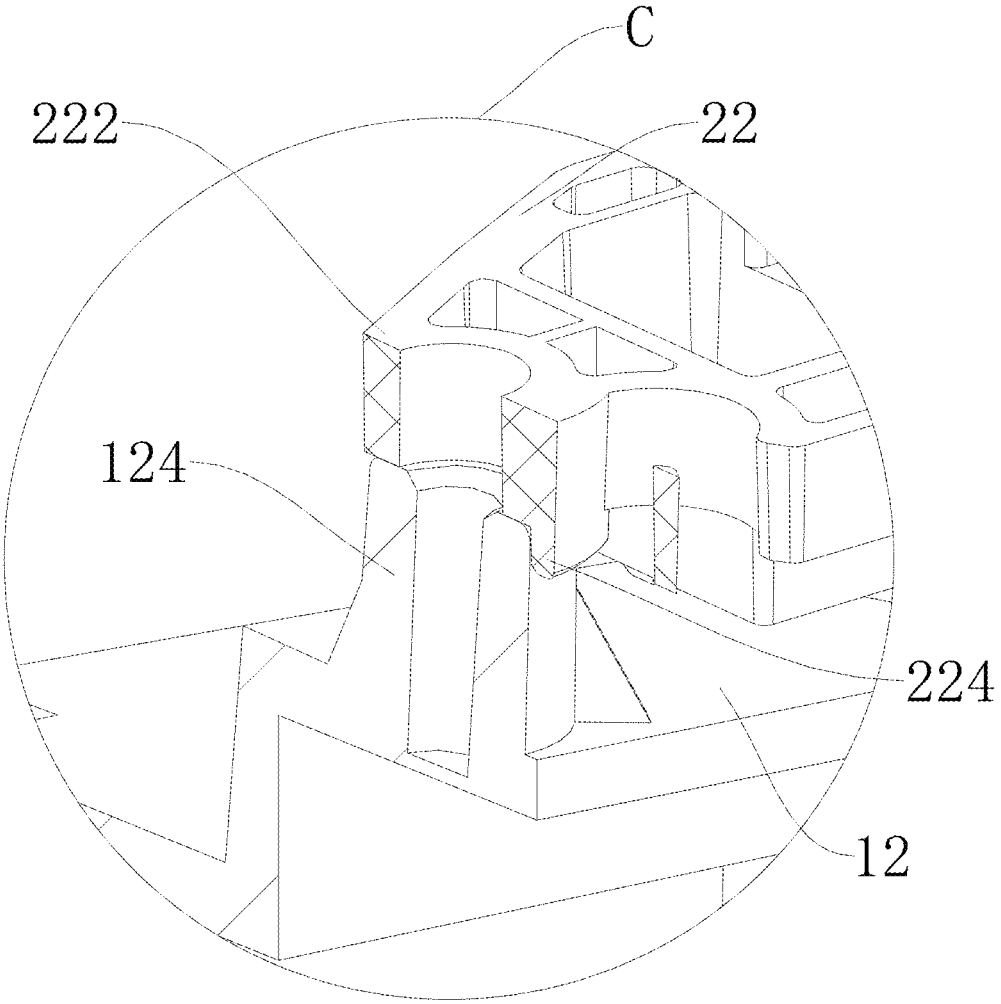
FIG. 12 is an enlarged view of portion C in FIG. 11.
Figure 13:
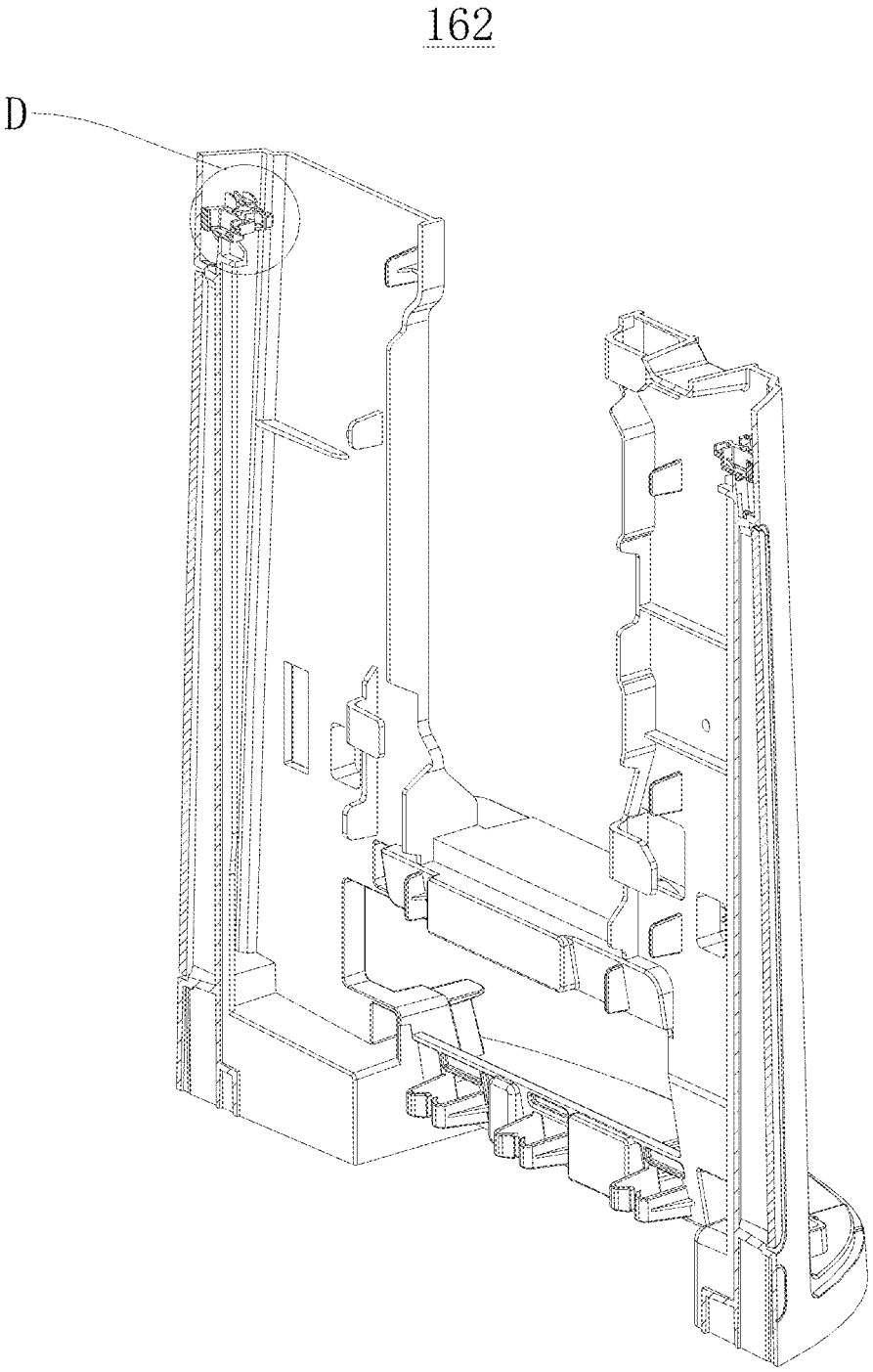
FIG. 13 is a schematic diagram of a lower rear box member according to an embodiment of the present disclosure.
Figure 14:
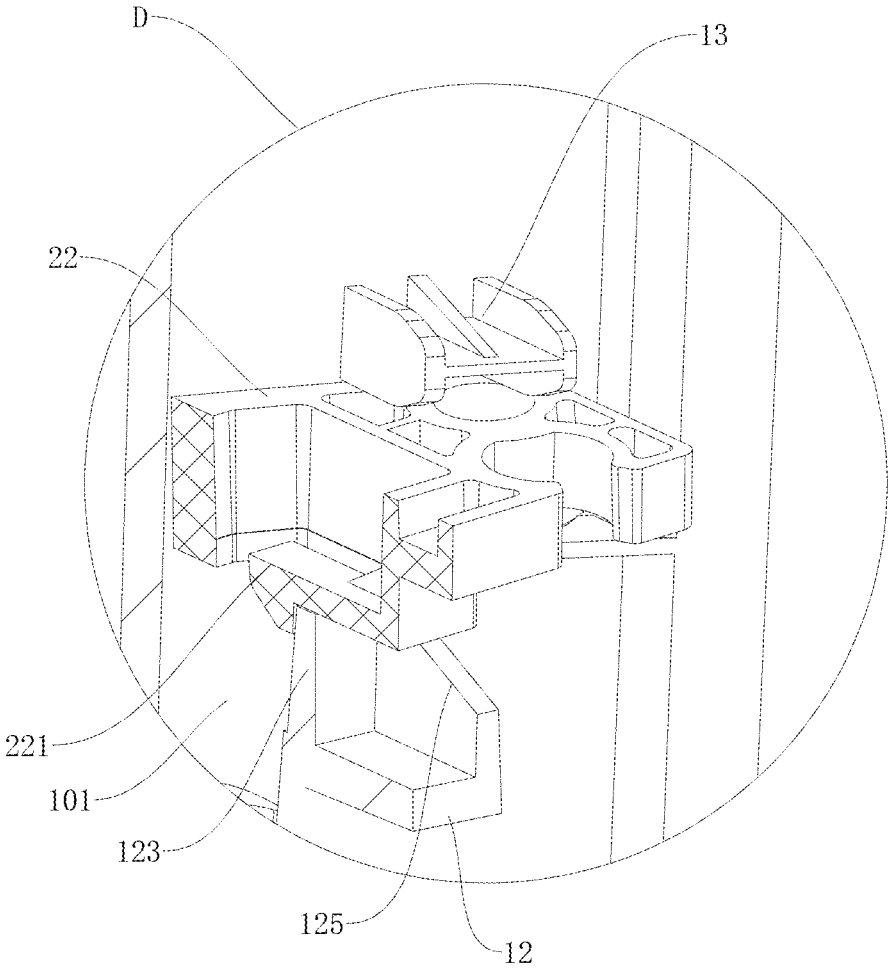
FIG. 14 is an enlarged view of portion D in FIG. 13.

In some exemplary embodiments of the present disclosure, as shown in FIG. 10, the limit rib 224 is formed in a circular arc shape, enabling the limit rib 224 to be completely attached to an outer surface of the fixing post to improve the limiting effect.

Figure 6:
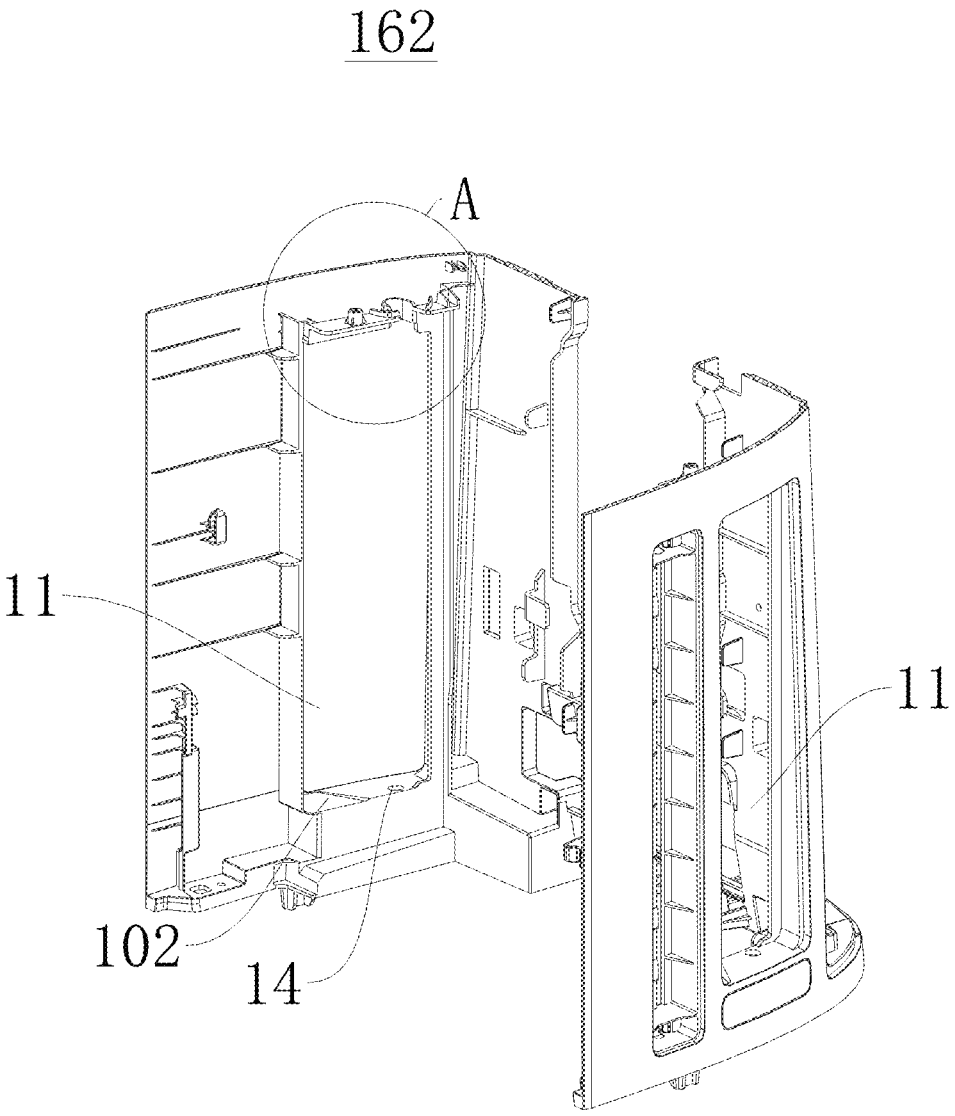
FIG. 6 is a schematic diagram of a lower rear box member according to an embodiment of the present disclosure.
Figure 7:
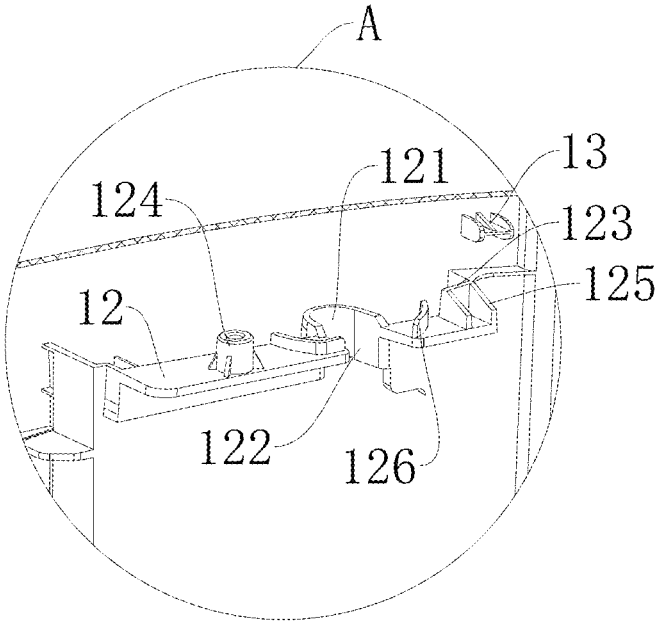
FIG. 7 is an enlarged view of portion A in FIG. 6.
Figure 8:
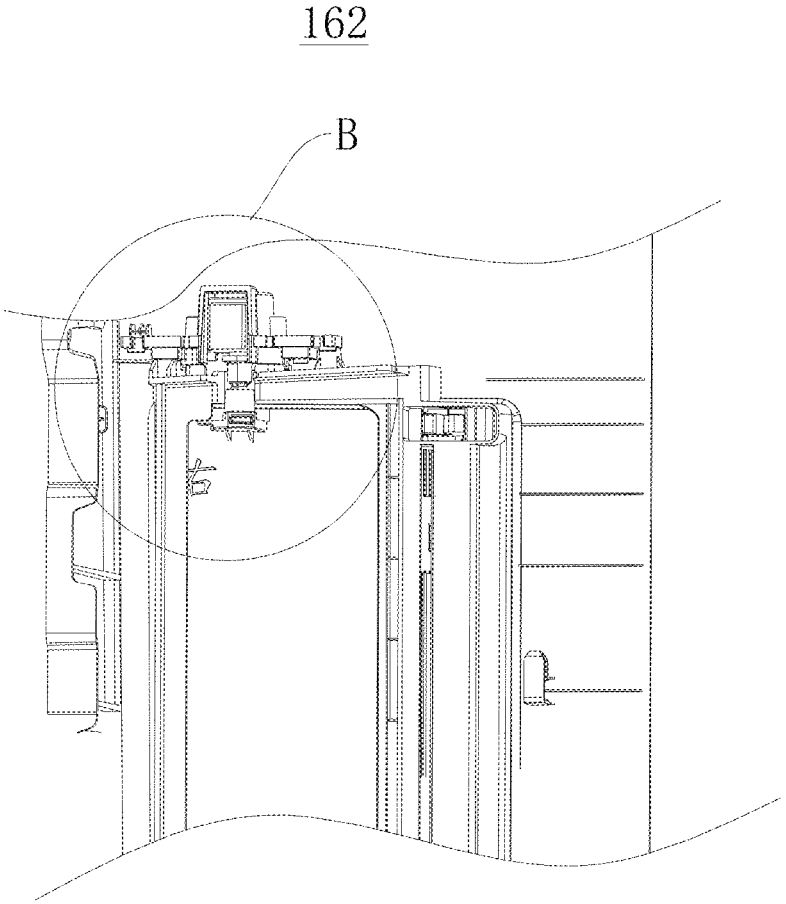
FIG. 8 is a schematic diagram of the lower rear box member as viewed from an angle different from that of FIG. 6.
Figure 9:
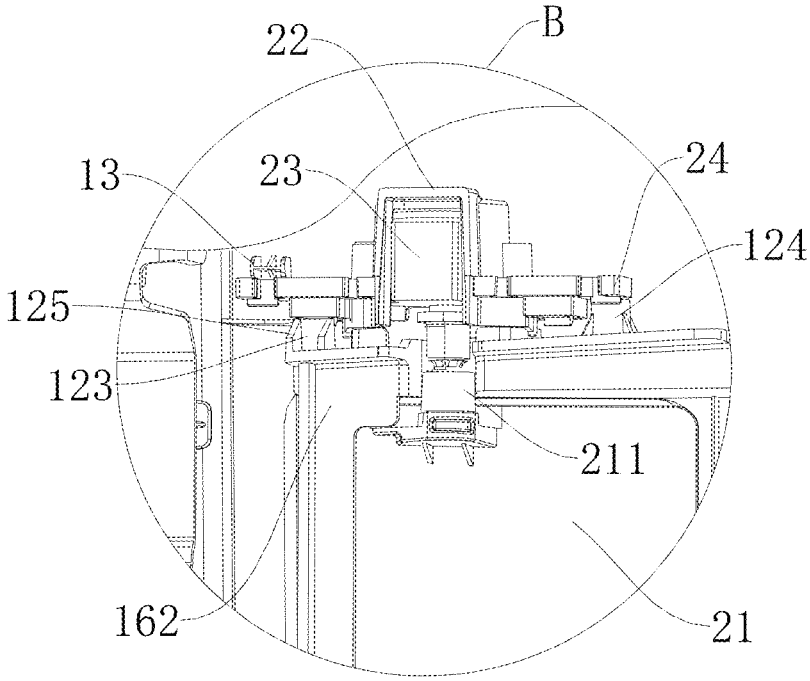
FIG. 9 is an enlarged view of portion B in FIG. 8.

In some embodiments of the present disclosure, as shown in FIG. 6 and FIG. 7, the mounting boss 12 is provided with a first guide member 126, and the motor cover 22 is provided with a second guide member 223. When an operator mounts the door opening and closing device 20, the second guide member 223 cooperates with the first guide member 126, and guides the motor cover 22 at a fixed position. It should be noted that, when the operator mounts the door opening and closing device 20, i.e., when assembling the motor cover 22 on the mounting boss 12, the second guide member 223 is moved to a position corresponding to the first guide member 126. Then, the second guide member 223 can move along the first guide member 126, enabling a connection position of the mounting boss 12 to correspond to a connection position of the motor cover 22. That is, the second snap portion 123 can be snapped with the first snap portion 221 to complete assembly of the mounting boss 12 and the motor cover 22. In this way, when the mounting boss 12 and the motor cover 22 are assembled, the mounting boss 12 and the motor cover 22 can be guided by the cooperation of the second guide member 223 and the first guide member 126, enabling the assembly efficiency of the mounting boss 12 and the motor cover 22 to be improved and avoiding the phenomenon that the assembly duration is too long due to inaccurate snap positions.

In some embodiments of the present disclosure, as shown in FIG. 6 and FIG. 7, the first guide member 126 is disposed at an outer side of the first shaft hole 121, and is an arc-shaped guide plate. The second guide member 223 may be a guiding post. It should be explained that, when the operator mounts the door opening and closing device 20, i.e., when assembling the motor cover 22 on the mounting boss 12, the guiding post is firstly placed at a position corresponding to the position of the arc-shaped guide plate, and then the guiding post is moved along an arc of the guide plate. In this way, the connection position of the mounting boss 12 and the connection position of the motor cover 22 correspond to each other, i.e., the connection positions are a position where the second snap portion 123 can be snapped with the first snap portion 221, to complete the assembly between the mounting boss 12 and the motor cover 22. In this arrangement, when the mount boss 12 and the motor cover 22 are assembled, the mounting boss 12 and the motor cover 22 can be guided through the cooperation of the guiding post and the arc-shaped guide plate, enabling the assembly efficiency of the mounting boss 12 and the motor cover 22 to be improved, and avoiding the phenomenon that the assembly duration is too long due to inaccurate snap positions. The guide plate with the arc shape can reduce a resistance applied to the guiding post when the guiding post moves along the arc-shaped guide plate, which further improves the assembly efficiency of the mounting boss 12 and the motor cover 22.

It should be understood that the second guide member 223 and the first guide member 126 may also be formed into other structures. For example, the second guide member 223 is formed into an extending protrusion extending into an arc-shaped groove, and the first guide member 126 is formed in a form of the arc-shaped groove, as long as the second guide member 223 is engaged with the first guide member 126 to guide the motor cover 22 to the fixed position.

In some embodiments of the present disclosure, as shown in FIG. 6 to FIG. 7, the air conditioner indoor unit 100 may further includes a positioning boss 13. The positioning boss 13 is disposed at the inner wall of the housing 10. The motor cover 22 is partially located between the mounting boss 12 and the positioning boss 13 to restrict a freedom of movement of the motor cover 22. In an example of the present disclosure, the number of the positioning bosses 13 corresponds to the number of the mounting bosses 12. The mounting boss 12 and the positioning boss 13 cooperate with each other to fix the motor cover 22 at a position. It should be understood that the number of the positioning bosses 13 is not limited thereto, and the number of the positioning bosses 13 may be three, four, or the like. In this way, the freedom of movement of the motor cover 22 on the mounting boss 12 can be constant, avoiding the air conditioner indoor unit 100 from being damaged due to the movement of the motor cover 22 on the mounting boss 12.

In some embodiments of the present disclosure, as shown in FIG. 6 and FIG. 7, a spacing between opposing sidewalls of the mounting notch 122 gradually increases away from the first shaft hole 121. It may further be interpreted that the two opposite sidewalls of the mounting notch 122 are not parallel and extending directions of the two opposite sidewalls of the mounting notch 122 are both away from the first shaft hole 121. An angle between the extending direction of one of the two opposite sidewalls of the mounting notch 122 and a direction away from the first shaft hole 121 is the same as an angle between the extending direction of another one of the two opposite sidewalls of the mounting notch 122 and a direction away from the first shaft hole 121. In an exemplary embodiment of the present disclosure, the angles between the extending directions of the two opposite side walls of the mounting notch 122 and the direction away from the first shaft hole 121 may be 15°. It should be understood that the angles between the extending directions of the two opposite side walls of the mounting notch 122 and the direction away from the first shaft hole 121 is not limited thereto. The angles between the extending directions of the opposite two side walls of the mounting notch 122 and the direction away from the first shaft hole 121 may also be 30°, 45°, or the like. This arrangement can facilitate mounting of the first pivoting portion 211 in the first shaft hole 121, and limit a certain freedom of the first pivoting portion 211 subsequent to successful mounting, avoiding instability of an overall structure of the air conditioner indoor unit 100 caused by movement of the first pivoting portion 211 in the mounting notch 122, facilitating the assembly, and improving the reliability of the product.

Figure 5:
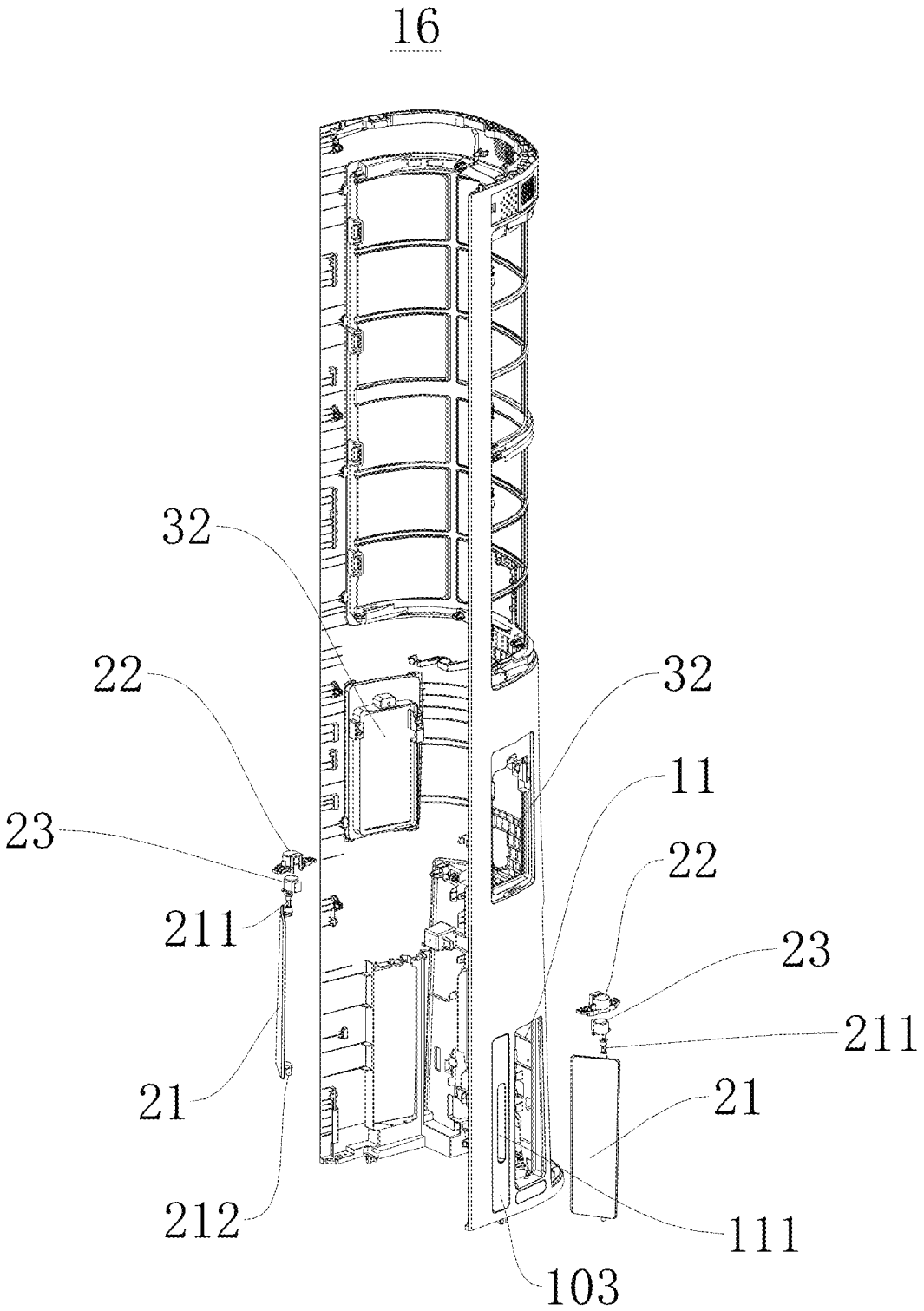
FIG. 5 is a schematic exploded view of the rear box component.

In some embodiments of the present disclosure, as shown in FIG. 5, a sidewall of the vent 11 opposite to the first shaft hole 121 is formed into a support plane 102. A second shaft hole 14 may be disposed at the support plane 102. The second pivoting portion 212 may be disposed at the valve 21, and the second shaft hole 14 and the second pivoting portion 212 may be rotatably engaged.

Figure 2:
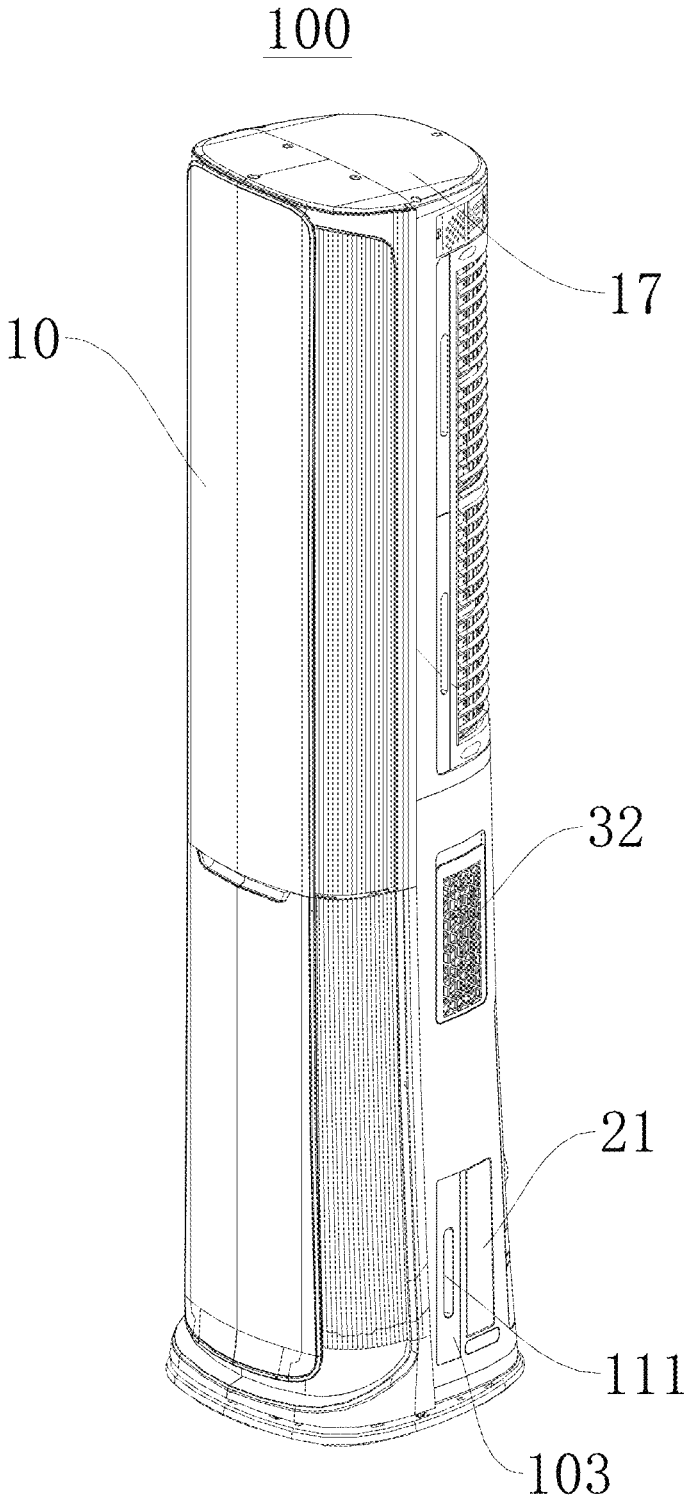
FIG. 2 is a schematic assembly view of the air conditioner indoor unit according to the embodiment of the present disclosure.
Figure 3:
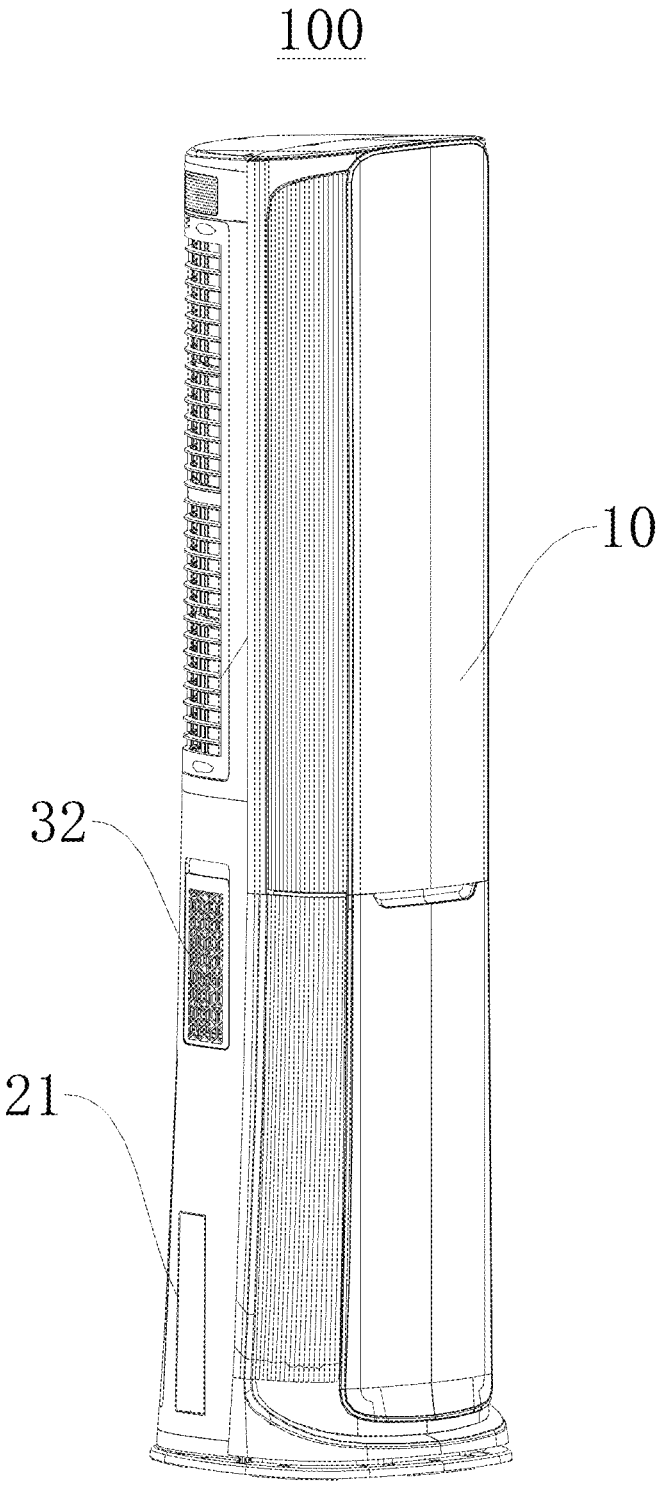
FIG. 3 is another schematic assembly view of the air conditioner indoor unit as viewed from an angle different from that of FIG. 2.
Figure 4:
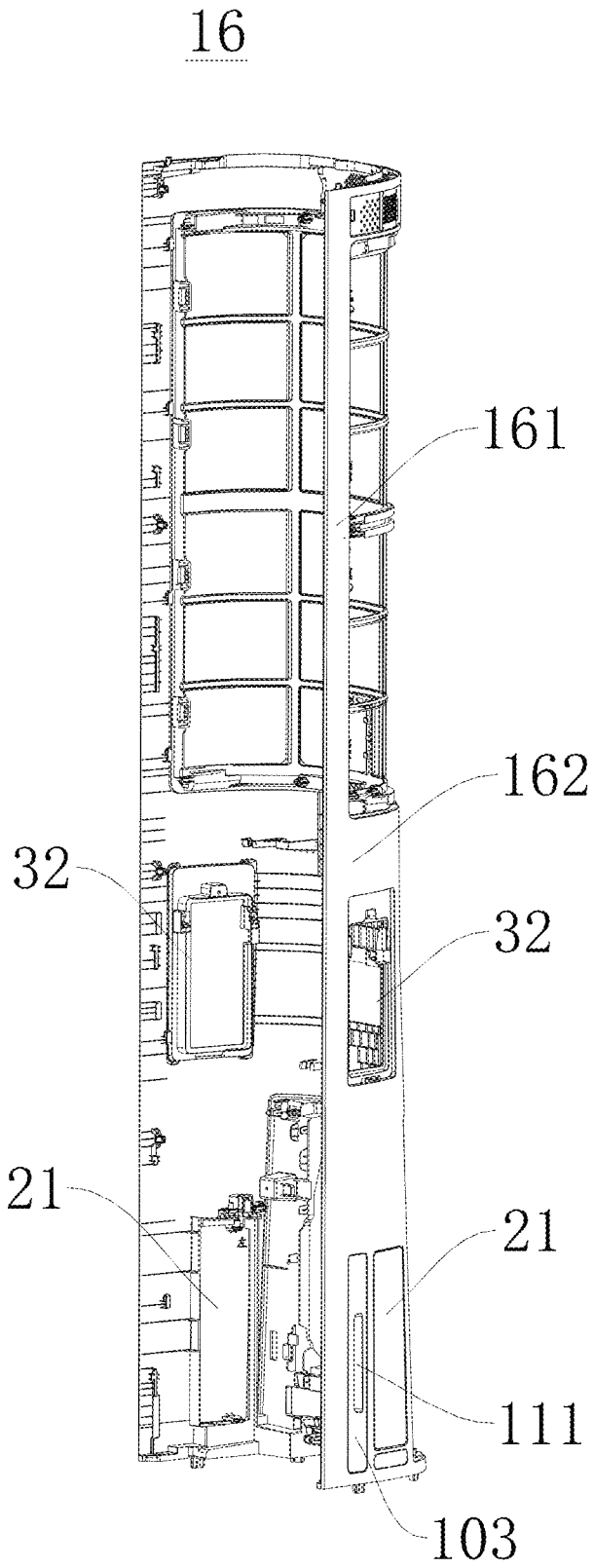
FIG. 4 is a schematic diagram of a rear box component according to an embodiment of the present disclosure.

In an exemplary embodiment of the present disclosure, a shape of the vent 11 is in a square shape. As shown in FIG. 1 to FIG. 3, the sidewall of the vent 11 opposite to the first shaft hole 121 is a lower wall of the vent 11. It should be understood that the upper and lower orientations are only described with reference to the drawings, and the orientations may be defined based on actual use situations. For example, the sidewall of the vent 11 opposite to the first shaft hole 121 can be a rear wall of the vent. The shape of the vent 11 is not limited thereto, for example, the shape of the vent 11 may be an elliptic shape. The valve 21 may be disposed on the sidewall of the vent 11 opposite to the first shaft hole 121. The valve 21 may close or open the vent 11 by the rotatably engagement between the second pivoting portion 212 and the second shaft hole 14. The support plane 102 is provided to support the valve. Two ends of the valve are supported to improve stability of the valve during the rotation.

When the air conditioner indoor unit 100 is in operation, the vent 11 needs to be opened for air exchange. The first pivoting portion 211 is engaged with the motor shaft 231 of the motor 23. The motor 23 drives the first pivoting portion 211 to rotate, which in turn drives the valve 21 to rotate. When the second pivoting portion 212 rotates counterclockwise relative to the second shaft hole 14, the valve 21 is opened and the vent 11 is opened. When the second pivoting portion 212 rotates clockwise relative to the second shaft hole 14, the valve 21 is closed and the vent 11 is closed.

When mounting the door opening and closing device, the second pivoting portion 212 is inserted obliquely into the second shaft hole 14, the first pivoting portion 211 of the door opening and closing device 20 assembled into one piece is then mounted in the first shaft hole 121 through the mounting notch 122, and thereafter the mounting boss 12 is fixed to the motor cover 22.

In some embodiments of the present disclosure, the housing 10 has a plurality of vents 11, the air conditioner indoor unit includes a plurality of door opening and closing devices 20, and each of the plurality of door opening and closing devices 20 is provided for one of the plurality of vents 11. The motor cover 22 is formed into a symmetrical structure that is symmetrical with respect to a center rotation axis of the motor shaft 231. The motor covers 22 of the plurality of door opening and closing devices 20 have the same shape. Therefore, the motor covers 22 of the plurality of door opening and closing devices 20 may be the same component, thereby reducing the number of components and reducing costs. In an exemplary embodiment of the present disclosure, two vents 11 and two door opening and closing devices 20 may be provided. The two vents 11 may be disposed on left and right sides of the lower rear box member 162, respectively. Each of the door opening and closing devices 20 includes a valve 21 and a motor 23. The motor cover 22 may be formed into a central symmetric structure that is symmetric with respect to the center rotation axis of the motor shaft 231. It should be understood that the number of the vents 11 and the number of the door opening and closing devices 20 are not limited thereto, and may be configured based on the actual requirements. For example, the number of the vents 11 and the number of the door opening and closing devices 20 each may be three, four, or the like. In this way, the air conditioner indoor unit 100 can improve cooling or heating effect. The motor cover 22 is formed into the central symmetric structure that is symmetric with respect to the center rotation axis of the motor shaft 231, which can reduce the costs of the air conditioner indoor unit 100, simplify the structure of the air conditioner indoor unit 100, and facilitate the assembly of the air conditioner indoor unit 100.

In some embodiments of the present disclosure, the mounting boss 12 and the housing 10 may be integrally formed. In this way, the mounting boss 12 and the housing 10 can be integrally processed, and the number of components can be reduced. An overall structural strength of the air conditioner indoor unit 100 can be improved, and a separate component for mounting the motor 23 is not required, thereby facilitating mounting.

In some embodiments of the present disclosure, as shown in FIG. 1, the housing 10 is internally provided with a purification device 30, and the vent 11 is an indoor air inlet. When the valve 21 is opened, indoor air flows into the housing 10 through the vent 11 and is then discharged after being purified by the purification device 30. In an exemplary embodiment of the present disclosure, the purification device 30 includes a purification air fan and a purification air filter assembly 103. The purification air fan may include a fan assembly, an air outflowing volute assembly, and an air inflowing volute assembly, etc. The purification air fan may be provided with a mounting plate, which may be configured to assemble and fix the purification air fan to the rear box component 16. In an embodiment, the mounting plate is fixedly connected with a fan volute and an air outflowing volute. The mounting plate may be integrated with the fan volute and the air outflowing volute. It should be understood that the connection manner of the mounting plate with the fan volute and the air outflowing volute is not limited thereto. For example, the mounting plate is connected with the fan volute and the air outflowing volute in a snap manner.

Further, the air outflowing volute assembly may have an air outlet. For example, the air outflowing volute assembly may have a plurality of the air outlets. The air inflowing volute assembly may have an air inlet, e.g., the air inflowing volute assembly may have a plurality of the air inlets. In an exemplary embodiment of the present disclosure, two air outlets are formed at the air outflowing volute assembly, and two air inlets are formed at the air volute assembly. The air outlets may be provided with a guide sealing structure. The guide seal structure is engaged with a fresh air outlet formed at the rear box component 16.

The purification air fan may provide power for air flowing in the purification device 30, and the purification air filter assembly 103 mainly has a filtering function. The purification air filter assembly 103 may include an intermediate filter, an air outflowing filter, and an air inflowing filter. The air inflowing filter may be disposed at the housing 10. The air inflowing filter may be a filter. The air inflowing filter has a preliminary filtering function, and atmospheric pollutants with a relatively large volume is preliminarily filtered by the filter. For example, as shown in FIG. 1, the filter may be disposed at the housing 10 in a drawable manner. A filter handle 111 may be disposed at the filter. It is possible to pull the filter out of the housing 10 by the filter handle 111 of the filter to clean or replace the filter. The intermediate filter may be arranged between the air outflowing filter and the air inflowing filter, and has a primary filtering function. The filter may be an electrostatic chemical fiber filter, and can have a secondary filtering function. Atmospheric pollutants with a relatively small volume can be adsorbed and filtered by the filter. The air outflowing filter is disposed at the air outflowing volute assembly, and the air outflowing filter may be a filter. The air outflowing filter functions to three-stage filtration, and the atmospheric pollutants with the relatively large volume that have not been filtered by the air inflowing filter can be filtered again by the filter.

The housing 10 may have a fresh air inlet and a purified air outlet 32. The purified air outlet 32 may be disposed at the upper rear box member 161. Therefore, when the air conditioner indoor unit 100 performs an indoor circulation purification function, the valve 21 opens the vent 11. Indoor air flows into the air inflowing volute assembly through the vent 11, and sequentially flows through the air inflowing filter, the filter, and the air outflowing filter to complete three times of filtration. Then, purified air is discharged from the air outflowing volute assembly through the purified air outlet 32 of the housing 10, achieving an effect of circulating and purifying the indoor air.

When fresh air needs to be introduced, outdoor fresh air flows into the air inflowing volute assembly through the fresh air inlet, and is filtered for three times through the air inflowing filter, the filter, and the air outflowing filter in sequence. Then, purified air is discharged from the air outflowing volute assembly through the purified air outlet 32 of the housing 10, achieving a large fresh air volume and large purification amount and realizing the purpose of introducing purified fresh air.

In the description of the present disclosure, descriptions with reference to the terms "an embodiment," "some embodiments," "examples," "specific examples," or "some examples" etc., mean that specific features, structure, materials, or characteristics described in conjunction with the embodiment or example are included in at least one embodiment or example of the present disclosure. In this description, the schematic representations of the above terms do not necessarily refer to the same embodiment or example. Moreover, the described specific features, structures, materials or characteristics may be combined in one or more embodiments or examples in a suitable manner.

Although embodiments of the present disclosure have been illustrated and described, it is conceivable for those skilled in the art that various changes, modifications, replacements, and variations can be made to these embodiments without departing from the principles and spirit of the present disclosure. The scope of the present disclosure shall be defined by the claims as appended and their equivalents.

What is claimed is:

1. An air conditioner indoor unit comprising:

a housing comprising an inner wall provided with a mounting boss, the housing having at least one vent, the mounting boss having a first shaft hole and a mounting notch formed at a side wall of the mounting boss facing away from the housing, the mounting notch being in communication with the first shaft hole, and the mounting boss being located at a side of each of the at least one vent; and at least one door opening and closing device comprising a valve, a motor cover, and a motor, the valve being rotatably located at the at least one vent to open or close the at least one vent, the valve being provided with a first pivoting portion rotatably engaged to the first axial hole, the motor having a motor shaft cooperating with the first pivoting portion to drive the valve to rotate, the motor cover internally having a mounting space for the motor, the first pivoting portion assembled with the motor being mounted in the first shaft hole through the mounting notch, and the motor cover being fixed at the mounting boss;

the motor cover is provided with a first snap portion and a first fixing portion; and the mounting boss is provided with a second snap portion and a second fixing portion, the first snap portion being snapped with the second snap portion, and each of the first fixing portion and the second fixing portion cooperating with a fixing connector to fixedly connect the motor cover and the mounting boss.

2. The air conditioner indoor unit according to claim 1, wherein:

the first snap portion comprises a resilient snap;

the second snap portion comprises a limit protrusion disposed at the mounting boss; and a snap space is formed between the limit protrusion and the inner wall of the housing, the resilient snap partially extending into the snap space and abutting against the limit protrusion.

3. The air conditioner indoor unit according to claim 2, wherein the limit protrusion has a snap-guiding surface obliquely extending towards the inner wall of the housing, the snap-guiding surface being engaged with the first snap portion to guide the first snap portion partially into the snap space.

4. The air conditioner indoor unit according to claim 1, wherein:

the first fixing portion has a through hole formed at the motor cover;

the second fixing portion comprises a fixing post; and the motor cover is provided with a limit rib engaged with an outer peripheral wall of the fixing post to limit the fixing post.

5. The air conditioner indoor unit according to claim 1, wherein:

the mounting boss is provided with a first guide member; and the motor cover is provided with a second guide member, the first guide member and the second guide member being engaged with each other to guide the motor cover to a fixing position when mounting the at least one door opening and closing device.

6. The air conditioner indoor unit according to claim 5, wherein:

the first guide member comprises an arc-shaped guide plate disposed outside of the first shaft hole; and the second guide member comprises a guiding post disposed at the motor cover.

7. The air conditioner indoor unit according to claim 1, further comprising:

a positioning boss disposed at the inner wall of the housing, the motor cover being partially located between the positioning boss and the mounting boss to restrict a freedom of movement of the motor cover.

8. The air conditioner indoor unit according to claim 1, wherein a spacing between opposing sidewalls of the mounting notch gradually increases away from the first shaft hole.

9. The air conditioner indoor unit according to claim 1, wherein:

a sidewall of the at least one vent opposite to the first shaft hole is formed into a support plane, the support plane having a second shaft hole; and the valve is provided with a second pivoting portion rotatably engaged to the second shaft hole.

10. The air conditioner indoor unit according to claim 1, wherein:

the at least one vent comprises a plurality of vents, the at least one door opening and closing device comprises a plurality of door opening and closing devices, and each of the plurality of door opening and closing devices being provided for a corresponding one of the plurality of vents;

the motor cover is formed into a symmetrical structure that is symmetrical with respect to a rotation center axis of the motor shaft; and the motor covers of the plurality of door opening and closing devices have a same shape.

11. The air conditioner indoor unit according to claim 1, wherein the mounting boss and the housing are integrally formed.

12. The air conditioner indoor unit according to claim 1, wherein:

the housing is internally provided with a purification device, the at least one vent being an indoor air inlet; and when the valve is opened, indoor air flows into the housing through the at least one vent and is discharged after being purified by the purification device.

* * * * *